US009512684B2

(12) United States Patent
Khaparde et al.

(10) Patent No.: US 9,512,684 B2
(45) Date of Patent: Dec. 6, 2016

(54) SHOCK TOOL FOR DRILLSTRING

(71) Applicant: HALLIBURTON ENERGY SERVICES, INC., Houston, TX (US)

(72) Inventors: Ashish Prafulla Khaparde, Pune (IN); Ragi Lohidakshan Poyyara, Maharashtra (IN); Krunal Kanubhai Mehta, Gujarat (IN)

(73) Assignee: Halliburton Energy Services, Inc., Houston, TX (US)

( * ) Notice: Subject to any disclaimer, the term of this patent is extended or adjusted under 35 U.S.C. 154(b) by 235 days.

(21) Appl. No.: 14/382,436

(22) PCT Filed: Nov. 22, 2013

(86) PCT No.: PCT/US2013/071461
§ 371 (c)(1),
(2) Date: Sep. 2, 2014

(87) PCT Pub. No.: WO2015/076825
PCT Pub. Date: May 28, 2015

(65) Prior Publication Data

US 2016/0230479 A1 Aug. 11, 2016

(51) Int. Cl.
*E21B 17/07* (2006.01)

(52) U.S. Cl.
CPC ..... *E21B 17/07* (2013.01); *E21B 17/073* (2013.01)

(58) Field of Classification Search
CPC ..... E21B 17/07; E21B 1/073
See application file for complete search history.

(56) References Cited

U.S. PATENT DOCUMENTS

| | | | | |
|---|---|---|---|---|
| 3,156,106 | A | 11/1964 | Crane | |
| 3,230,740 | A | 1/1966 | Fox | |
| 3,339,380 | A | 9/1967 | Fox | |
| 3,947,008 | A * | 3/1976 | Mullins | E21B 17/07 267/125 |
| 3,998,443 | A | 12/1976 | Webb | |
| 4,183,415 | A | 1/1980 | Stenuick | |
| 4,194,582 | A | 3/1980 | Ostertag | |
| 4,443,206 | A | 4/1984 | Teng | |
| 4,901,806 | A | 2/1990 | Forrest | |
| 6,308,940 | B1 * | 10/2001 | Anderson | E21B 17/073 175/300 |
| 6,543,556 | B1 * | 4/2003 | Anderson | E21B 31/107 166/178 |

(Continued)

OTHER PUBLICATIONS

International Search Report and Written Opinion of the International Searching Authority issued in International Application No. PCT/US2013/071461 on Aug. 14, 2014; 11 pages.

(Continued)

*Primary Examiner* — Nicole Coy
(74) *Attorney, Agent, or Firm* — Alan Bryson; Parker Justiss, P.C.

(57) ABSTRACT

A shock tool for a drill string includes an outer tubular housing having female multi-spiral helical spline grooves disposed on an interior surface of the housing, and an inner tubular mandrel having a portion of an exterior circumferential surface with mating male multi-spiral helical splines. The inner tubular mandrel is telescopically and rotationally received in the outer tubular housing with the male splines received in the female spline grooves of the housing.

21 Claims, 5 Drawing Sheets

(56) References Cited

U.S. PATENT DOCUMENTS

| | | | | |
|---|---|---|---|---|
| 7,044,240 | B2 * | 5/2006 | McNeilly | E21B 17/073 175/299 |
| 7,578,360 | B2 | 8/2009 | Haughom | |
| 8,240,401 | B2 | 8/2012 | Wassell et al. | |
| 2004/0129457 | A1 | 7/2004 | McNeilly | |
| 2007/0000695 | A1 | 1/2007 | Laflin | |
| 2011/0198126 | A1 * | 8/2011 | Swietlik | E21B 17/073 175/55 |
| 2012/0228029 | A1 | 9/2012 | Reimers | |

OTHER PUBLICATIONS

PCT International Preliminary Report on Patentability, PCT/US2013/071461, Jun. 2, 2016, 8 pages.

* cited by examiner

A-A

SHOCK TOOL FOR DRILLSTRING

CLAIM OF PRIORITY

This application is a U.S. National Stage of International Application No. PCT/US2013/071461, filed Nov. 22, 2013.

TECHNICAL FIELD

This specification generally relates to a tool and method for absorbing axial and torsional shock loads in a drilling string.

BACKGROUND

In connection with the recovery of hydrocarbons from the earth, wellbores are generally drilled using a variety of different methods and equipment. According to one common method, a roller cone bit or fixed cutter bit is rotated against the subsurface formation to form the wellbore. The drill bit is rotated in the wellbore through the rotation of a drill string attached to the drill bit and/or by the rotary force imparted to the drill bit by a subsurface drilling motor powered by the flow of drilling fluid down through the drill string and through the drilling motor.

Downhole vibrations and shocks (referred to collectively and/or interchangeably herein as "shock loads") are induced by interactions between the rotating bit and various types of hard rock and/or "sticky" earth formations at or near the floor of the wellbore. Shock loads induced at the drill bit are in turn transmitted to other components of the bottomhole assembly, as well as to the supporting drill string. Shock loads imparted on the drill string can diminish the life of its interconnected members by accelerating the process of fatigue. Additionally, excessive shock loads can cause spontaneous downhole equipment failure, wash-outs and a decrease in penetration rate.

Axial shock loads tend to cause a condition known as "bit bounce," where the drill bit momentarily lifts up and loses contact with the floor of the wellbore. Bit bounce is known to cause acute damage to bit cutters and supporting bearings. Torsional shock loads are often caused by a phenomenon known as "stick-slip." Stick-slip occurs when the drill bit stalls (e.g., drags or stops rotating completely) due to friction with the earth formations in the wellbore. When the drill bit stalls, typically, the attached drill string continues to turn, which can result in damage to the drill string and/or other components of the bottomhole assembly. Even if the operating torque applied through the drill string eventually succeeds in breaking the bit free of the formation, (i.e., overcoming the friction torque load on the bit resulting in a stall), the sudden release of the bit can cause it to rotate faster than the drill string. Stick-slip can cause problems in the operation of the drilling assembly and in the formation of the wellbore. In some cases, severe stick-slip can cause strong lateral vibrations in the drill string, which are also damaging.

Downhole shock loads are a major contributor to the failure of various components of the downhole equipment. Downhole shock loads may also cause damage to the wellbore itself (e.g., when lateral vibrations cause the drill string to contact the walls of the wellbore). Thus, mitigation of downhole shock loads is key to avoiding non-productive time and preventing equipment damage

DESCRIPTION OF THE DRAWINGS

Many of the features are exaggerated to better show the features, process steps, and results. Like reference numbers and designations in the various drawings indicate like elements.

DETAILED DESCRIPTION

Figure 1:
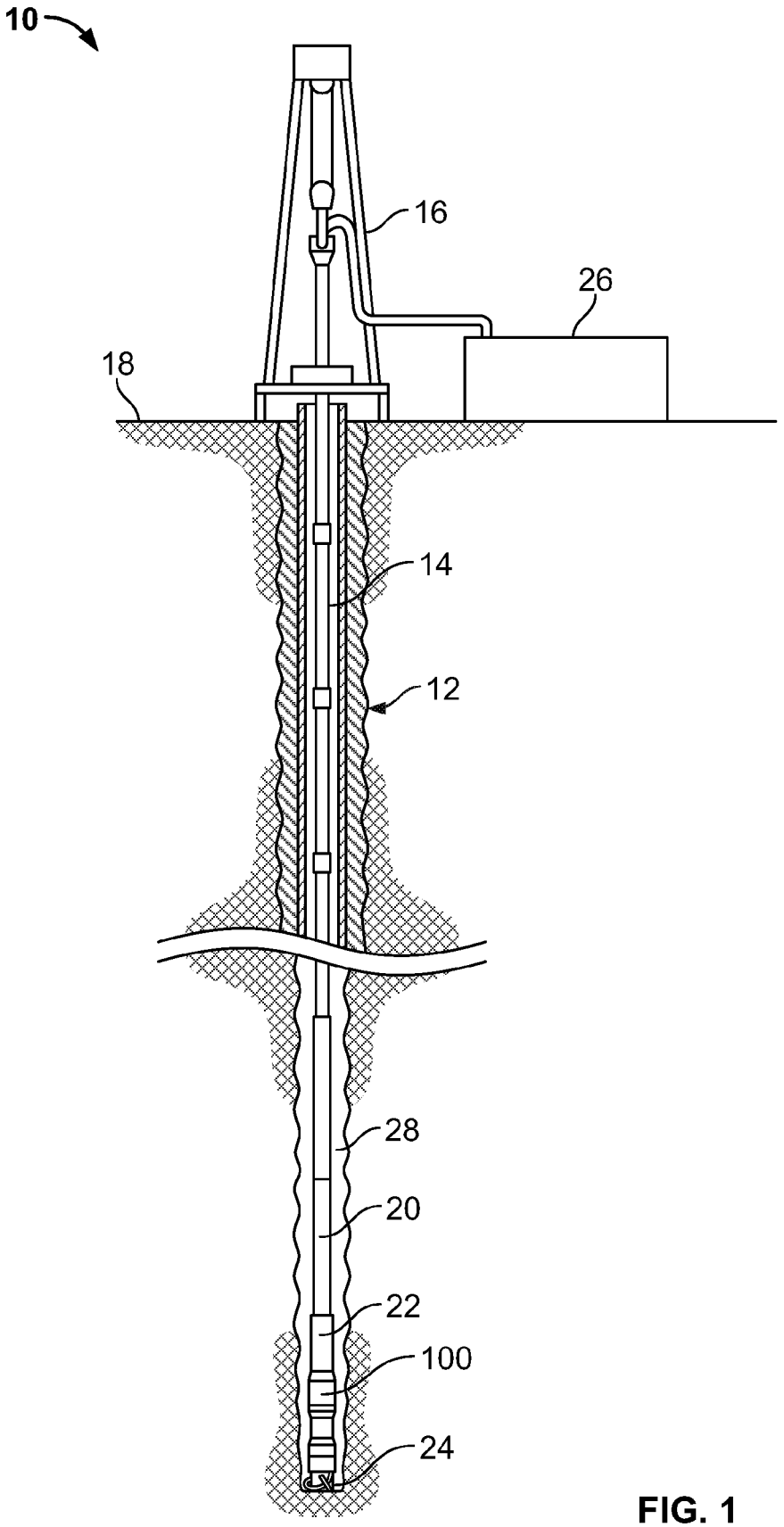
FIG. 1 is a diagram of an example drilling rig for drilling a wellbore.

FIG. 1 is a diagram of an example drilling rig 10 for drilling a wellbore 12. The drilling rig 10 includes a drill string 14 supported by a derrick 16 positioned generally on an earth surface 18. The drill string 14 extends from the derrick 16 into the wellbore 12. The lower end portion of the drill string 14 includes at least one drill collar 20, and in some implementations includes a subsurface drilling fluid-powered motor 22, and a drill bit 24. The drill bit 24 can be a fixed cutter bit, a roller cone bit, or any other type of bit suitable for drilling a wellbore. A drilling fluid supply system 26 circulates drilling fluid (often called "drilling mud") down through a bore of the drill string 14 for discharge through or near the drill bit 24 to assist in the drilling operations. The drilling fluid then flows back toward the surface 18 through an annulus 28 formed between the wellbore 12 and the drill string 14.

The wellbore 12 can be drilled by rotating the drill string 14, and therefore the drill bit 24, using a rotary table or top drive, and/or by rotating the drill bit with rotary power supplied to the subsurface motor 22 by the circulating drilling fluid. A shock tool assembly 100 in accordance with one or more concepts of the present disclosure is positioned below the subsurface motor 22. As described below, the shock tool assembly 100 absorbs both axial and torsional shock loads generated as the rotating drill bit 24 cuts through earth to create the wellbore 12.

In the foregoing description of the drilling rig 10, various items of equipment, such as pipes, valves, pumps, fasteners, fittings, etc., may have been omitted to simplify the description. However, those skilled in the art will realize that such conventional equipment can be employed as desired. Those skilled in the art will further appreciate that various components described are recited as illustrative for contextual purposes and do not limit the scope of this disclosure. Further, while the drilling rig 10 is shown in an arrangement that facilitates straight downhole drilling, it will be appreciated that directional drilling arrangements are also contemplated and therefore are within the scope of the present disclosure.

Figure 2A:
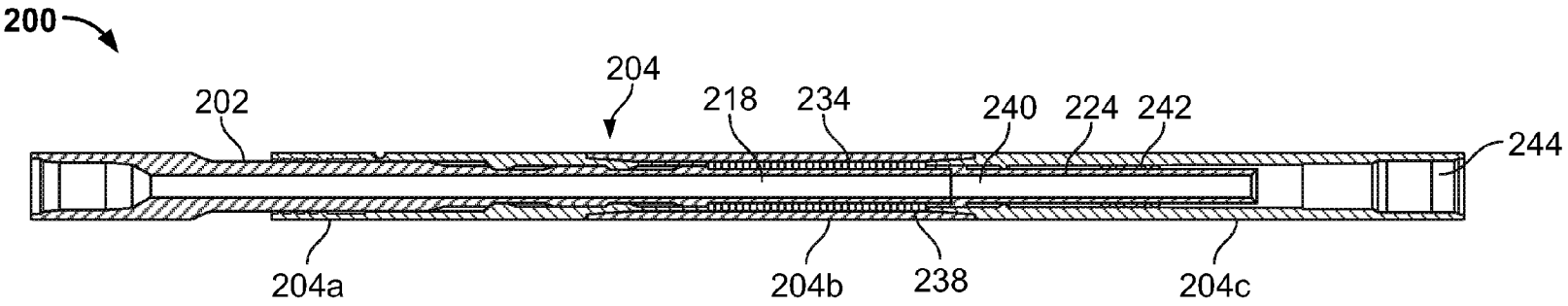
FIG. 2A is a half, side cross-sectional view of an example shock tool assembly.
Figure 2B:
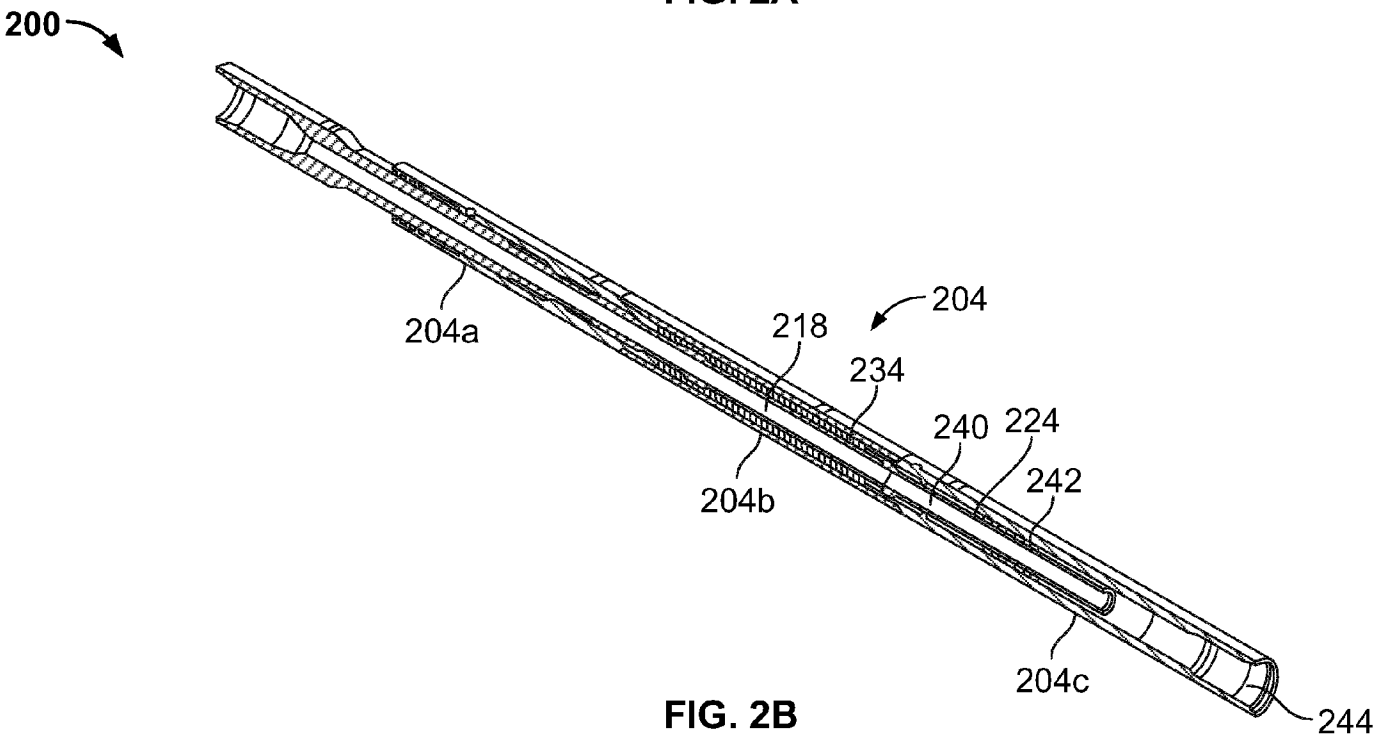
FIG. 2B is a half, perspective cross-sectional view of the shock tool assembly.
Figure 3A:
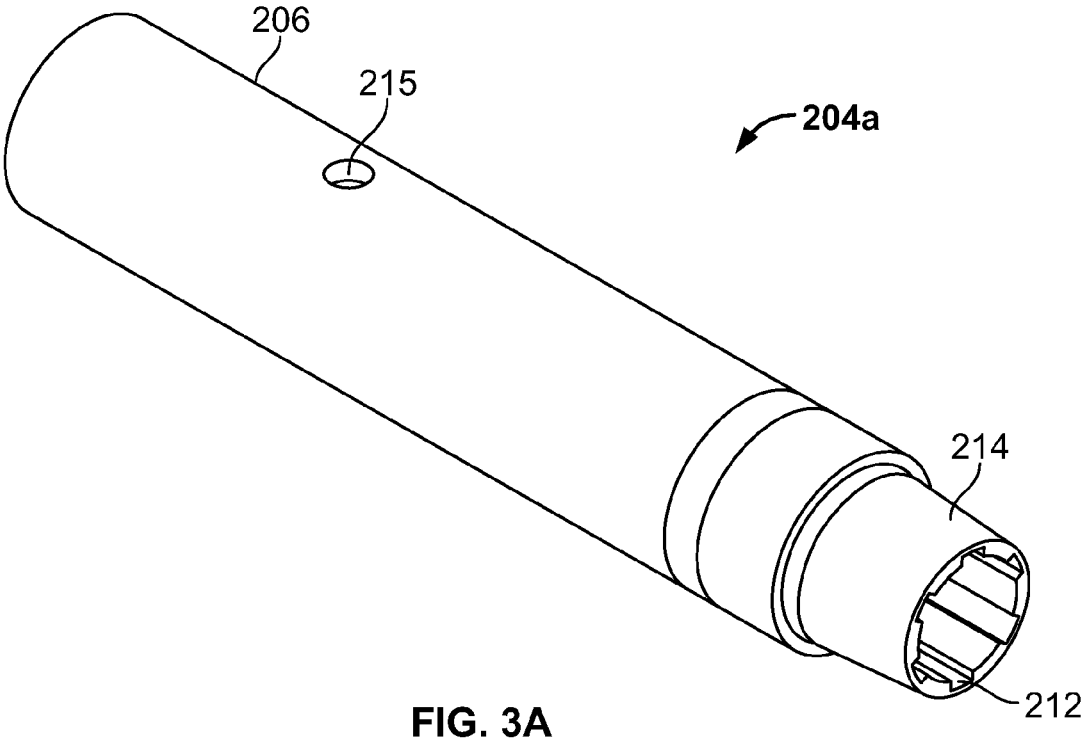
FIG. 3A is a perspective view of a shock tool housing of the shock tool assembly of FIGS. 2A and 2B.
Figure 3B:
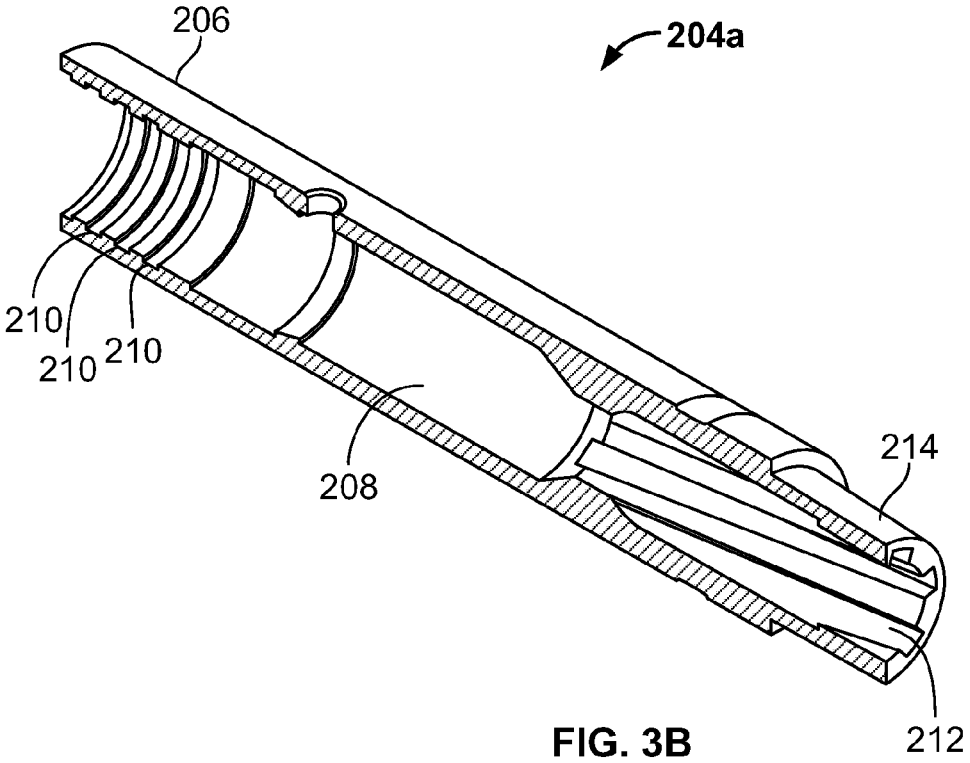
FIG. 3B is half, perspective cross-sectional view of the shock tool housing.
Figure 3C:
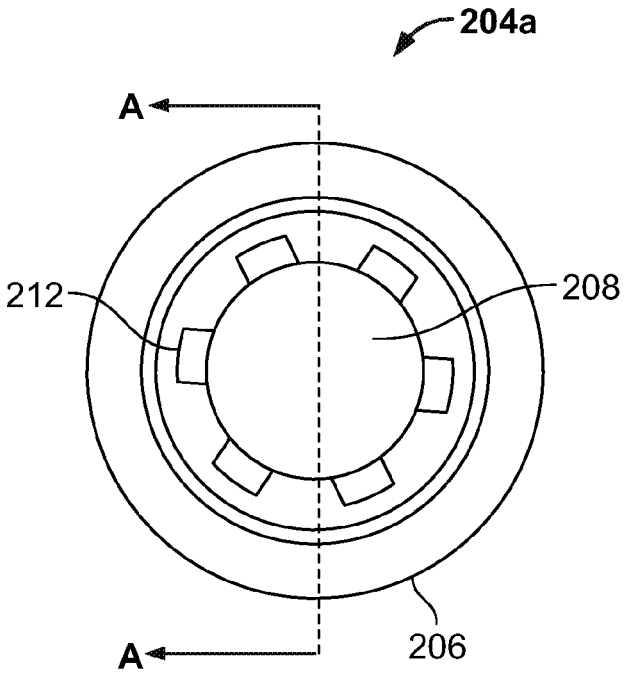
FIG. 3C is a top view of the shock tool housing.
Figure 3D:
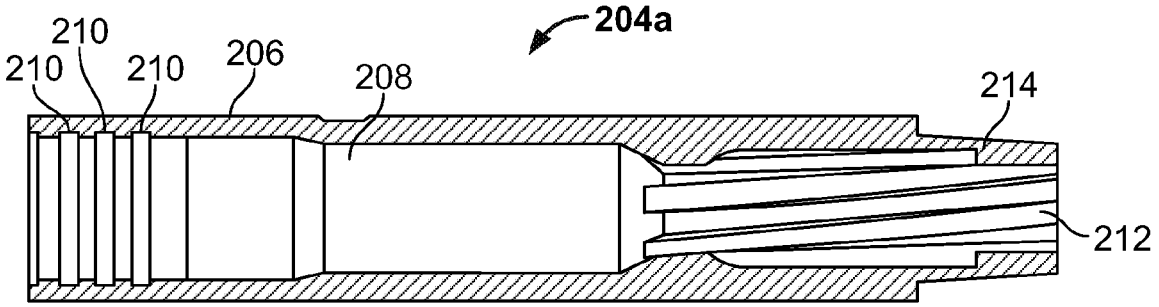
FIG. 3D is a half, side cross-sectional view of the shock tool housing, taken along the Section A-A marked in FIG. 3C.

FIGS. 2A and 2B depict an example shock tool assembly 200 that can, for example, be incorporated in the drilling rig 10 as an extension of the drilling string 14 projecting into the wellbore 12. As shown, the shock tool assembly 200 features an elongated tubular mandrel 202 and a collinear elongated tubular housing 204 that receives the mandrel 202 in a central bore. During operation of the drilling rig 10, the mandrel 202 is driven (e.g., via its connection to the rotating drill string 14 or by the subsurface motor 22) to rotate about a longitudinal centerline. The mandrel 202 is coupled to the housing 204 such that torque imparted on the rotationally driven mandrel is transferred to the housing, causing the housing to rotate together with the mandrel. When the shock tool assembly 200 is deployed in the drilling string 14, the drill bit 24 is installed at the bottom end of the housing 204 and turns as the housing turns. As described in detail herein, the shock tool assembly 200 is designed to absorb both axial and torsional shock loads encountered by the drill bit 24 during the rotational drilling process.

In this example, the housing 204 is a multi-component sub-assembly, including a splined housing 204*a*, a spring housing 204*b*, and a piston housing 204*c*. The splined housing 204*a*, spring housing 204*b*, and piston housing 204*c* are coupled to one another in an end-to-end configuration (e.g., by mating threads or by press fitting). The splined housing 204*a* is positioned above spring housing 204*b*, which is positioned above the piston housing 204*c*. In other implementations one or more of the housings 204*a*, 204*b* and 204*c* may be formed as a single integral housing.

Note that use of terminology such as "above" and "below" to describe elements is for describing relative orientations of the various components of the assembly. For example, "above" used in this context means proximal to the beginning of the drill string (i.e., at the point where the drill string is connected to the drilling rig); and "below" means distal to the beginning of the drill string (or proximal to the end of the drill string, toward the floor of the wellbore). Unless otherwise stated explicitly, the use of such terminology does not imply a particular position or orientation of the assembly or any other components relative to the direction of the Earth gravitational force, or the Earth ground surface.

The mandrel 202 engages the splined housing 204*a* via a mating set of helical splines and grooves. The mating splines and groove facilitate relative telescoping movement between the mandrel 202 and the housing 204. Thus, the mandrel 202 and housing 204 are designed to move in combined rotation and axial motion relative to one another via the matching helical splines and grooves.

Turning now to FIGS. 3A-3D, the splined housing 204*a* includes a tubular body 206 having a central bore 208 for receiving a portion of the mandrel 202. The upper portion of the bore 208 defines a plurality of sealing trenches 210, which can be fitted with dynamic seals (e.g., dynamic O-ring seals) that engage an outer surface of the mandrel 202. The lower portion of the bore 208 features a pattern of female multi-spiral spline grooves 212. The spline grooves 212 are appropriately configured (e.g., in terms of number, size, shape, and pitch angle) to accommodate a matching pattern of male splines formed on the mandrel 202. The lower portion of the splined housing 204*a* defines a reduced-diameter coupling 214 for attaching the splined housing to the spring housing 204*b*. A port 215 is provided in the cylindrical side wall of the splined housing 204*a* for introducing lubricant oil.

Figure 4A:
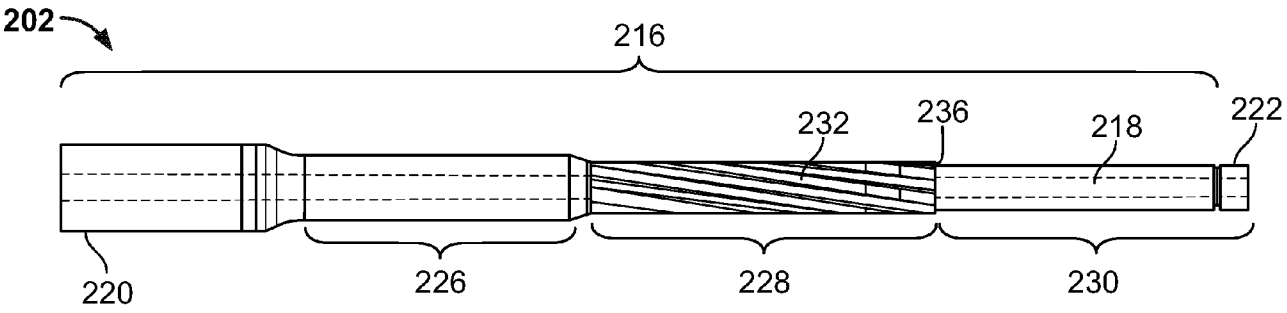
FIG. 4A is a side view of a shock tool mandrel of the shock tool assembly of FIGS. 2A and 2B.
Figure 4B:
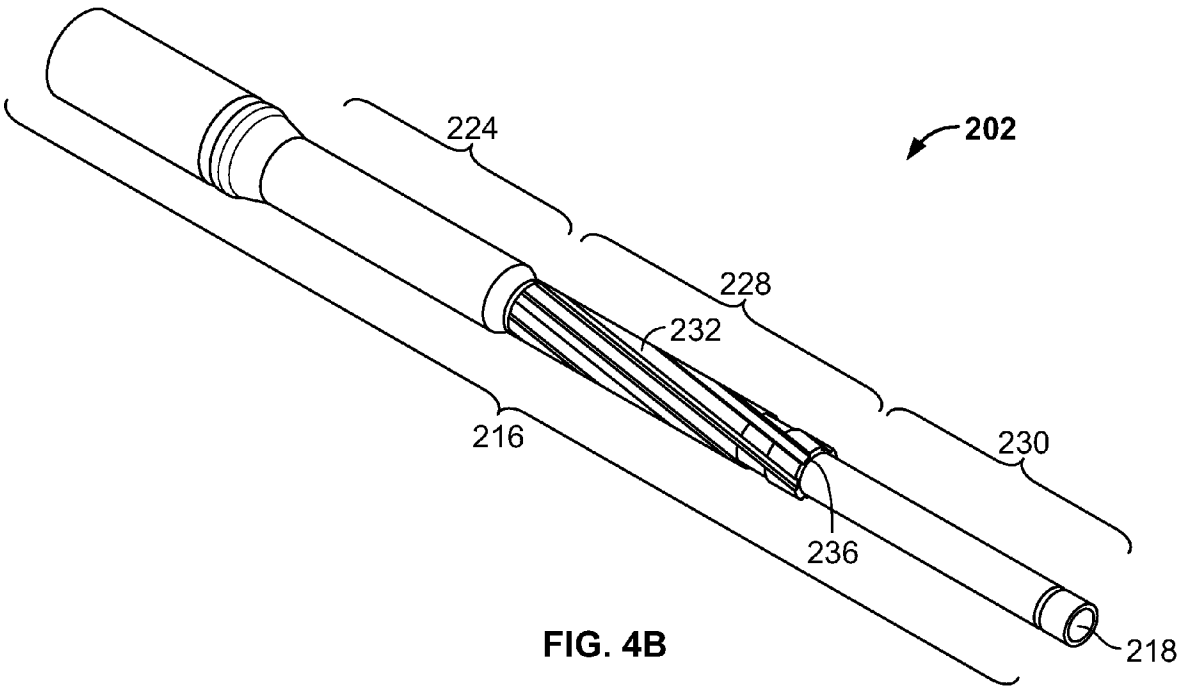
FIG. 4B is a perspective view of the shock tool mandrel.

Turning next to FIGS. 4A and 4B, the mandrel 202 includes an elongated tubular body 216 having a central bore 218 for conveying drilling fluid from the drill sting 14 onward towards the drill bit 24. The top end of the mandrel 202 defines a coupling 220 for connecting the mandrel to the drill string 14. The bottom end of the mandrel 202 defines a coupling 222 for connecting the drill string to a wash pipe 224 (see FIGS. 2A and 2B). Between its top and bottom ends, the mandrel 202 defines a sealing portion 226, a spline portion 228, and a spring portion 230.

The sealing portion 226 of the mandrel 202 is provided having a substantially smooth outer surface. The diameter of the sealing portion 226 closely mirrors that of the spline housing's central bore 208, so that the dynamic seals located in the sealing trenches 210 bear against the smooth outer surface of the mandrel 202. The spline portion 228 features a pattern of male, multi-spiral splines 232. The male splines 232 are received by the female spline grooves 212 of the spline housing 204*a*, allowing the mandrel 202 to move telescopically and rotationally through the housing 204.

Similar to the sealing portion 226, the spring portion 230 exhibits a substantially uniform or smooth outer surface (i.e., a surface without splines). The diameter of the spring portion 230 is significantly less than that of the spline portion 228, so as to form an annulus between the outer surface of the mandrel and the inner surface of the spring housing's central bore. The annulus is designed to accommodate a resilient member 234 (see FIGS. 2A and 2B). The abrupt transition between the spline portion 228 and the reduced-diameter spring portion 230 creates the shoulder 236 for positioning the top end of the resilient member 234.

Referring back to FIGS. 2A and 2B, the spring housing 204*b* is positioned below the splined housing 204*a*. The spring housing 204*b* receives the spring portion 230 of the mandrel 202, below the helical splines 232, with the resilient member 234 located in the annulus and situated between the radially protruding shoulder 236 of the mandrel 202 and a rim 238 at the upper end of the piston housing 204*c*.

In this example, the resilient member 234 includes an arrangement of disc springs, e.g., Bellville discs. The resilient member 234 is designed to preload under WOB (Weight on Bit) and torque-transfer loads. Additional deflection beyond this initial preloading accommodates one or both of axial and torsional shock loads. The preload creates a biasing force in the resilient member 234 urging the mandrel 202 outwardly through the upper end of the spline housing 204*a*. The number of disc springs, the characteristics of the individual disc springs (e.g., spring force, static loading limit, dynamic loading limit, etc.), and the configuration of the arrangement (e.g., series or parallel) can be selected so as to provide the resilient member with appropriate performance properties. In some examples, the resilient member is designed to preload up to about 8% under WOB. In some examples, the resilient member is designed to preload up to about 15% under torque transfer conditions.

The piston housing 204*c* is positioned below the spring housing 204*b*. As noted above, the piston housing's rim 238 supports the lower end of the resilient member 234. The wash pipe 224 is coupled to the end of the mandrel 202 and projects downward into the central bore of the piston housing 204*c*. The bore 240 of the wash pipe 224 is aligned with the bore 218 of the mandrel 202, allowing drilling fluid to pass from the mandrel to the wash pipe. A balance piston 242 is located in an annulus between the outer surface of the wash pipe 224 and the inner surface of the central bore of the piston housing 204*c*. The balance piston 242 is designed to balance the pressure the lubricant oil with the pressure of the drilling fluid. The piston housing 204*c*, at its lower end, provides a coupling 244 for attaching directly or via other downhole equipment to the drill bit 24.

As noted above, the mandrel 202 is coupled to the housing 204 such that torque imparted on the rotationally driven mandrel is transferred to the housing, causing the housing to rotate together with the mandrel. This arrangement is permitted by cooperation between the mating splines 232 and grooves 212 together with the resilient member 234. The spiral nature of the splines 232 and grooves 212 tends to urge the mandrel 202 to rotationally and telescopically move through the housing 204 as the mandrel is rotated. However, the resilient member 234 is located between the housing 204 and the mandrel 202 and therefore resists the relative telescopic movement. When further movement of the mandrel 202 is prevented by spring force of the resilient member 234, the mandrel's splines 232 bear against the spline housing's grooves 212, resulting in a transfer of torque from the rotationally driven mandrel to the housing. The resilient member 234 is designed to preload under the force of the mandrel 202 bearing downward as it is rotated and urged through the housing 204.

Axial and torsional shock loads encountered by the drill bit 24 are imparted on the housing 204, urging the housing to move rotationally and telescopically relative to the rotating mandrel 202. This movement of the housing 204 relative to the mandrel 202, causing the housing to "ride up" the splines 232 of the mandrel, compressing the resilient member 234, which is positioned to resist the relative movement. Thus, the shock loads are absorbed by compression of the resilient member 234. Small axial and torsional vibrations and nominal shocks are also damped out by the resilient action of the resilient member 234. Larger excitements are damped out by the lubricant oil acting on the balance piston 242. For example, when the resilient member 234 compresses due to shock, the volume holding the lubricant oil is reduced, which in turn increases the oil pressure. The oil pressure increase causes the balance piston 242 to move downward to restore a pressure balance.

Characteristics of the helical splines 232 and grooves 212 are selected so as to balance the need to manage both torsional and axial shock loads encountered by the drill bit 24 with a single shock tool. This goal is accomplished, for example, in the illustrated embodiment where the geometry of the splines and grooves is a mult-start helical pattern having a pitch angle of about nine degrees measured from a longitudinal axis of the tool, with the splines and grooves exhibiting a rectangular cross-section. In some examples, the pitch angle is between about five and sixty degrees. As the pitch angle increases in severity, the shock tool is able to accommodate more torsional shock and less axial shock. Conversely, as the pitch angle decreases, the shock tool is able to accommodate more axial shock and less torsional shock. Creating a pitch angle of about twenty-two degrees provides substantial equal response to either axial or torsional shock loads. Thus, the pitch angle can be optimized for the expected drilling conditions. If more axial shock is expected verses torsional shock, then the pitch angle used can be less than twenty-two degrees, and vice versa.

In some implementations, the multi-spline arrangement described in the shock tool assembly 200 provides superior strength and wear resistance compared to a single spline. For example, the shear stress acting on the splines during operation of the shock tool is distributed evenly over the multiple splines, thereby reducing the stress in each individual spline.

A number of embodiments of the invention have been described. Nevertheless, it will be understood that various modifications may be made without departing from the spirit and scope of the inventions.

What is claimed:

1. A shock tool for a drill string positionable in a wellbore, said shock tool comprising:

an outer tubular housing having female multi-spiral helical spline grooves disposed on an interior surface of the housing, said housing including a lower connector for coupling to a spring housing; and an inner tubular mandrel having a portion of an exterior circumferential surface with male multi-spiral helical splines configured to mate with the female multi-spiral helical grooves of the outer tubular housing and at least a lower portion of the exterior circumferential surface of the mandrel not containing splines thereon, said inner tubular mandrel telescopically and rotationally received in the outer tubular housing with the male splines received in the female spline grooves of the outer tubular housing, said lower portion of the inner tubular mandrel without splines being received in the spring housing coupled to the outer tubular housing, said inner tubular mandrel having an axial fluid passageway for passage of drilling fluid supplied by the drill string through the mandrel, wherein said spring housing includes at least one disc spring disposed around the lower portion of the exterior surface of the mandrel not containing splines thereon and in an annulus between the mandrel and an inner surface of the spring housing, said disc spring having a predetermined biasing force that biases at least a portion of the mandrel outwardly through an axial opening in an upper end of the outer tubular housing.

2. The shock tool of claim 1, wherein the multi-spiral helical splines of the inner tubular mandrel have a pitch of between 5 degrees and 60 degrees measured from a longitudinal axis of the tool.

3. The shock tool of claim 2, wherein the multi-spiral helical splines of the inner tubular mandrel have a pitch of about 9 degrees from the longitudinal axis.

4. The shock tool of claim 2, wherein the multi-spiral helical splines of the inner tubular mandrel have a pitch of about 22 degrees from the longitudinal axis.

5. The shock tool of claim 1, wherein the disc spring positioned inside the spring housing is biased with a preload of WOB (Weight on Bit) and torque transfer.

6. The shock tool of claim 5, wherein the disc spring is biased at about 8% under WOB.

7. The shock tool of claim 5, wherein the disc spring is biased at about 15% under torque transfer.

8. The shock tool of claim 1, further comprising a balance piston located to facilitate dampening of axial and torsional shock loads absorbed by the disc spring.

9. The shock tool of claim 8, further comprising a piston housing coupled to the spring housing, the balance piston located in an annulus between the mandrel and the piston housing.

10. The shock tool of claim 8, further comprising lubricant oil contained in a space adjacent the balance piston, wherein a volume of the space decreases with compression of the disc spring.

11. The shock tool of claim 10, wherein the outer tubular housing is sealed against the mandrel to contain the lubricant oil.

12. The shock tool of claim 1, further comprising a wash pipe comprising a central bore aligned with the axial fluid passageway of the mandrel.

13. The shock tool of claim 12, wherein a change in diameter of the mandrel between the lower portion of the exterior circumferential surface of the mandrel not containing splines and the portion of the mandrel having the splines creates a shoulder abutting one end of the disc spring.

14. The shock tool of claim 1, wherein the lower portion of the exterior circumferential surface of the mandrel not containing splines comprises a smaller diameter than the portion of the mandrel having the splines.

15. A method of absorbing axial and torsional shock loads on a drill sting positioned in a wellbore, said method comprising:

installing a shock tool in a drill string, said shock tool including an outer tubular housing having a plurality of female multi-spiral helical spline grooves disposed on an interior surface of the housing, an inner tubular mandrel having a portion of an exterior circumferential surface with male multi-spiral helical splines configured to mate with the female multi-spiral helical grooves of the outer tubular housing and at least a lower portion of the exterior circumferential surface of the mandrel not containing splines thereon, said mandrel positioned in the outer housing with the male splines received in the female spline grooves of the housing, said lower portion of the mandrel without splines being received in a spring housing coupled to the outer tubular housing, wherein said spring housing includes at least one disc spring disposed around the lower portion of the exterior surface of the mandrel not containing splines thereon and in an annulus between the mandrel and an inner surface of the spring housing, said disc spring having a predetermined biasing force that biases at least a portion of the mandrel outwardly through an axial opening in an upper end of the outer tubular housing;

conducting drilling operations with the drill string and shock tool positioned in the wellbore;

receiving axial and torsional shock loads on a drill bit coupled to the shock tool;

rotating the outer tubular housing relative to the inner tubular mandrel in response to the axial and torsional shock loads;

translating rotary motion of the inner tubular mandrel into axial movement of the inner tubular mandrel inwardly into the outer tubular housing via the axial opening in the upper end of the outer tubular housing due to rotational movement of the male splines of the inner tubular mandrel received in the female spline grooves in the outer tubular housing; and compressing the disc spring due to inwardly axial motion of the inner tubular mandrel, thereby absorbing the torsional and axial shock loads imposed on the drill string.

16. The method of claim 15, further comprising dampening torsional and axial shock loads absorbed by the disc spring via a balance piston reacting to lubricant oil pressure.

17. The method of claim 16, wherein the lubricant oil is contained in a space adjacent the balance piston, wherein a volume of the space decreases with compression of the disc spring.

18. The method of claim 15, wherein the multi-spiral helical splines of the inner tubular mandrel have a pitch of between 5 degrees and 60 degrees measured from a longitudinal axis of the tool.

19. The method of claim 18, wherein the multi-spiral helical splines of the inner tubular mandrel have a pitch of about 9 degrees from the longitudinal axis.

20. The method of claim 15, wherein the disc spring positioned inside the spring housing is biased with a preload of WOB (Weight on Bit) and torque transfer.

21. A shock tool for a drill string positionable in a wellbore, said shock tool comprising:

an outer tubular housing having female multi-spiral helical spline grooves disposed on an interior surface of the housing; and an inner tubular mandrel having a portion of an exterior circumferential surface with male multi-spiral helical splines configured to mate with the female multi-spiral helical grooves of the outer tubular housing and at least a lower portion of the exterior circumferential surface of the mandrel not containing splines thereon, said inner tubular mandrel telescopically and rotationally received in the outer tubular housing with the male splines received in the female spline grooves of the outer tubular housing, said lower portion of the inner tubular mandrel without splines being received in a spring housing portion of the outer tubular housing, said inner tubular mandrel having an axial fluid passageway for passage of drilling fluid supplied by the drill string through the mandrel, wherein said spring housing portion of the outer tubular housing includes at least one disc spring disposed around the lower portion of the exterior surface of the mandrel not containing splines thereon and in an annulus between the mandrel and an inner surface of the spring housing portion of the outer tubular housing, said disc spring having a predetermined biasing force that biases at least a portion of the mandrel outwardly through an axial opening in an upper end of the outer tubular housing.

* * * * *